United States Patent [19]

Tondo et al.

[11] Patent Number: 4,727,804

[45] Date of Patent: Mar. 1, 1988

[54] TRASH COMPACTOR WITH OBLIQUELY DISPOSED COMPACTION CHAMBER AND CONVEYOR

[75] Inventors: Frank Tondo, Allendale; John B. Reilly, Dover; Rudy Tondo, Ringwood, all of N.J.

[73] Assignee: Arrow Steel Inc., Paterson, N.J.

[21] Appl. No.: 8,362

[22] Filed: Jan. 29, 1987

[51] Int. Cl.[4] ..... B30B 15/04; B30B 15/32

[52] U.S. Cl. ..... 100/215; 100/218; 100/240

[58] Field of Search ..... 100/215, 240, 179, 98 R, 100/188 R, 218

[56] References Cited

U.S. PATENT DOCUMENTS

| | | | |
|---|---|---|---|
| 2,591,970 | 4/1952 | Seegers et al. . | |
| 2,649,945 | 8/1953 | McClellan . | |
| 3,253,537 | 5/1966 | Porter et al. . | |
| 3,521,553 | 7/1970 | Smolka et al. | 100/218 X |
| 3,563,168 | 2/1971 | Doninger . | |
| 3,575,103 | 4/1971 | Charles . | |
| 3,603,247 | 9/1971 | Price . | |
| 3,604,345 | 9/1971 | Boje . | |
| 3,621,775 | 11/1971 | Dedio et al. . | |
| 3,695,172 | 10/1972 | Cleary et al. . | |
| 3,783,773 | 1/1974 | Willard et al. | 100/215 X |
| 3,802,337 | 4/1974 | St-Hiliare . | |
| 3,815,323 | 6/1974 | Longo . | |
| 3,913,474 | 10/1975 | Lewis . | |
| 4,099,457 | 7/1978 | Hyden . | |
| 4,134,335 | 1/1979 | O'Rourke . | |
| 4,144,806 | 3/1979 | Broussard | 100/218 X |
| 4,188,873 | 2/1980 | Gattyan . | |

OTHER PUBLICATIONS p. 67–Sept. 1970, Solid Waste Manag Management.

*Primary Examiner*—Andrew M. Falik

*Attorney, Agent, or Firm*—Banner, Birch, McKie & Beckett

[57] ABSTRACT

A commercial compactor for use for example in an apartment building for receiving trash from a chute and compacting it. The compactor has a ram for forcing the trash from a receiving chamber into a compacting chamber from which the compacted and bagged trash is deposited on a conveyor that for space purposes extends at a right angle to the centerline of the apparatus. The compacting chamber is arranged obliquely to the centerline of the apparatus whereby it provides resistance for compacting and, at the same time, reduces the overall length of the apparatus by incorporating some of the ninety degree bend in the compacting chamber and provides for the use of a conveyor having a bend that is less than ninety degrees by the amount of the bend in the compacting chamber.

2 Claims, 3 Drawing Figures

TRASH COMPACTOR WITH OBLIQUELY DISPOSED COMPACTION CHAMBER AND CONVEYOR

BACKGROUND OF THE INVENTION

This invention relates to commercial trash compactors of the type usually found for example in apartment buildings and particularly to trash compactors of the type that provides for the continuous extrusion of compacted trash and delivers it onto a conveyor for removal.

Compactors such as the ones disclosed for example in U.S. Pat. Nos. 3,802,337, 3,815,323 and 4,134,335 deliver compacted trash from the outlet end of a compacting or reduction chamber in the form of a discharge tube on a line that is an extension of the centerline of the unit. Compactors of this nature may deliver the compacted trash directly into a trash container or into a "sausage" bag supplied from the periphery of the compacting chamber or discharge tube and closed over the mouth thereof and into which the compacted trash is fed as the bag is drawn off the discharge tube. Compactors using "sausage" bags may have a conveyor for supporting the bag as it's being filled and to facilitate moving the filled bag to a storage or removal site. Both a trash container or conveyer are arranged to receive the compacted trash on a line along the centerline of the unit. This of course requires a relatively long overall length for the unit whereas space for this may not always be available in the building.

To reduce the overall length of the unit, compactors with conveyors for receiving the compacted trash have had the conveyors formed with a 90° turn for delivering the compacted trash at right angles to the centerline of the unit rather than in line with it. This of course reduces the overall length relative to that of a conveyor that delivers the compacted trash in line with the unit but it still has significant space requirements.

The object of this invention is to provide an arrangement wherein the overall length of the unit and thus its space requirements are reduced and which provides for efficient and continuous compaction.

SUMMARY OF THE INVENTION

In accordance with this invention, it has been found that the compacting chamber can be arranged obliquely relative to the centerline of the outlet opening of the trash-receiving chamber. In this arrangement, the bend in the compacting chamber provides resistance to the flow of the trash through the compacting chamber whereby the trash can be compacted against the previously compacted trash and thus provide a constant flow of the trash therethrough. At the same time, it also reduces the overall length of the compacting chamber as well as provides an initial turning of the compacted trash. In this manner the turning required in the conveyor to deliver the compacted trash at a right angle from the outlet end of the compacting chamber is reduced by the amount of turn in the compacting chamber. Typically, it has been found that half of the right angle turn can be in the compacting unit without providing too much resistance to the flow of the trash therethrough, or so much resistance that the unit will become bound. Thus, only half of the turn must be in the conveyor which significantly reduces the space requirements of the conveyor.

DETAILED DESCRIPTION OF THE INVENTION

Figure 1:
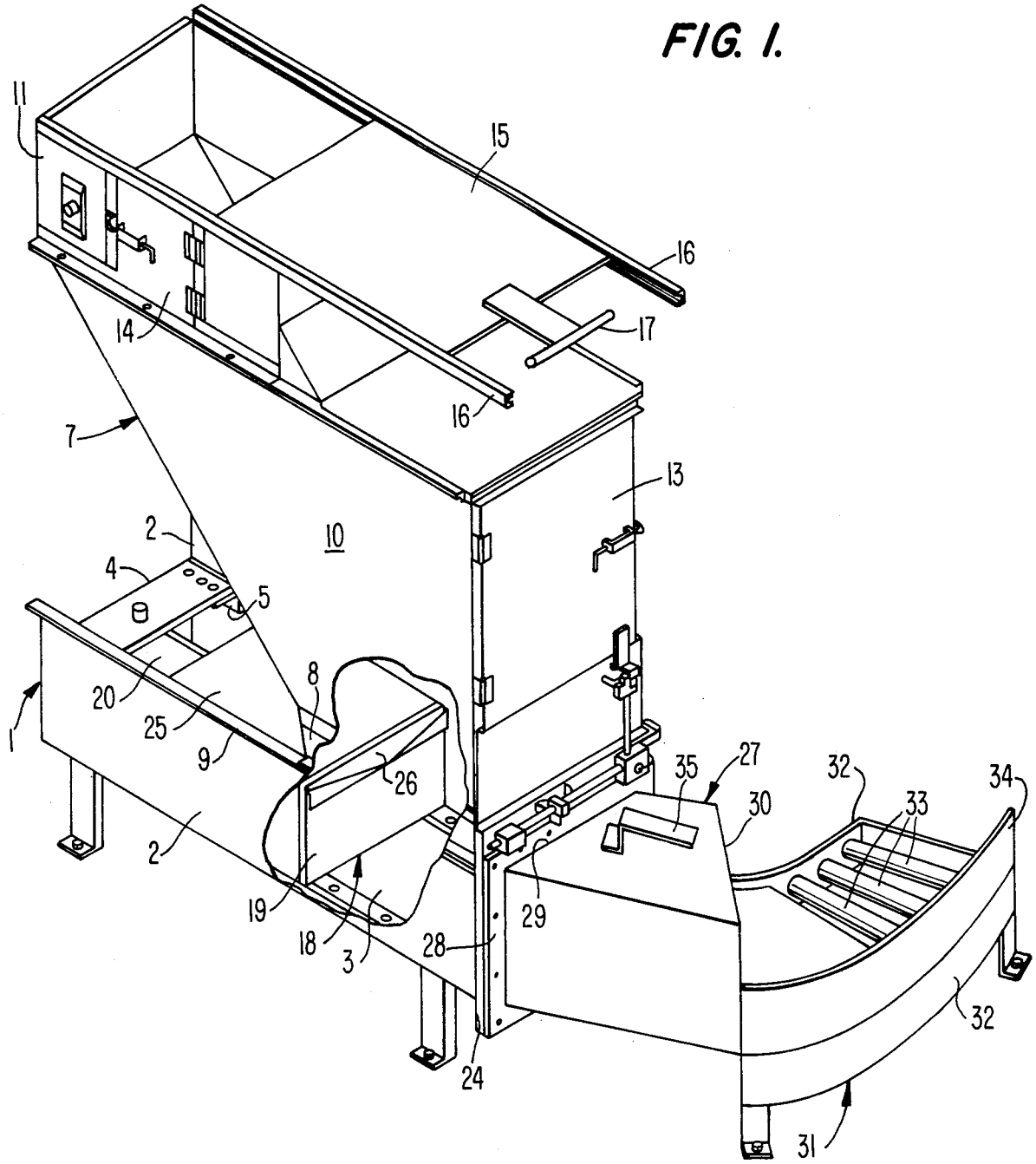
FIG. 1 is a perspective view of a compactor in accordance with this invention, a portion of the apparatus being broken away to illustrate the underlying elements.
Figure 2:
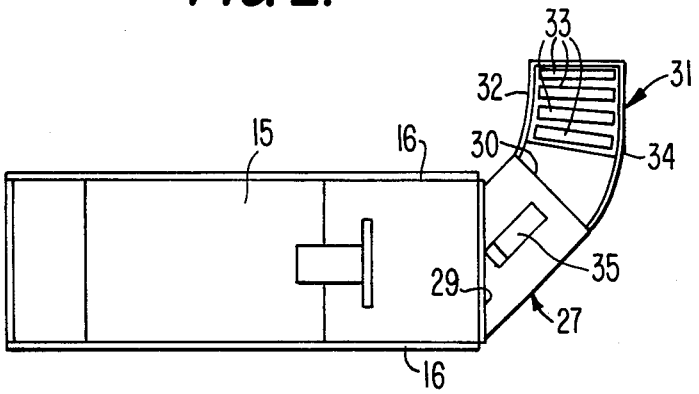
FIG. 2 is a top plan view of the conveyor of FIG. 1.

There is shown in the drawings a compactor having a U-shaped base 1 formed by spaced side plates 2 and a bottom plate 3. At its one end the base 1 has braces 4 disposed between the side plates 2 near the top and bottom thereof and secured thereto by brackets 5.

Figure 3:
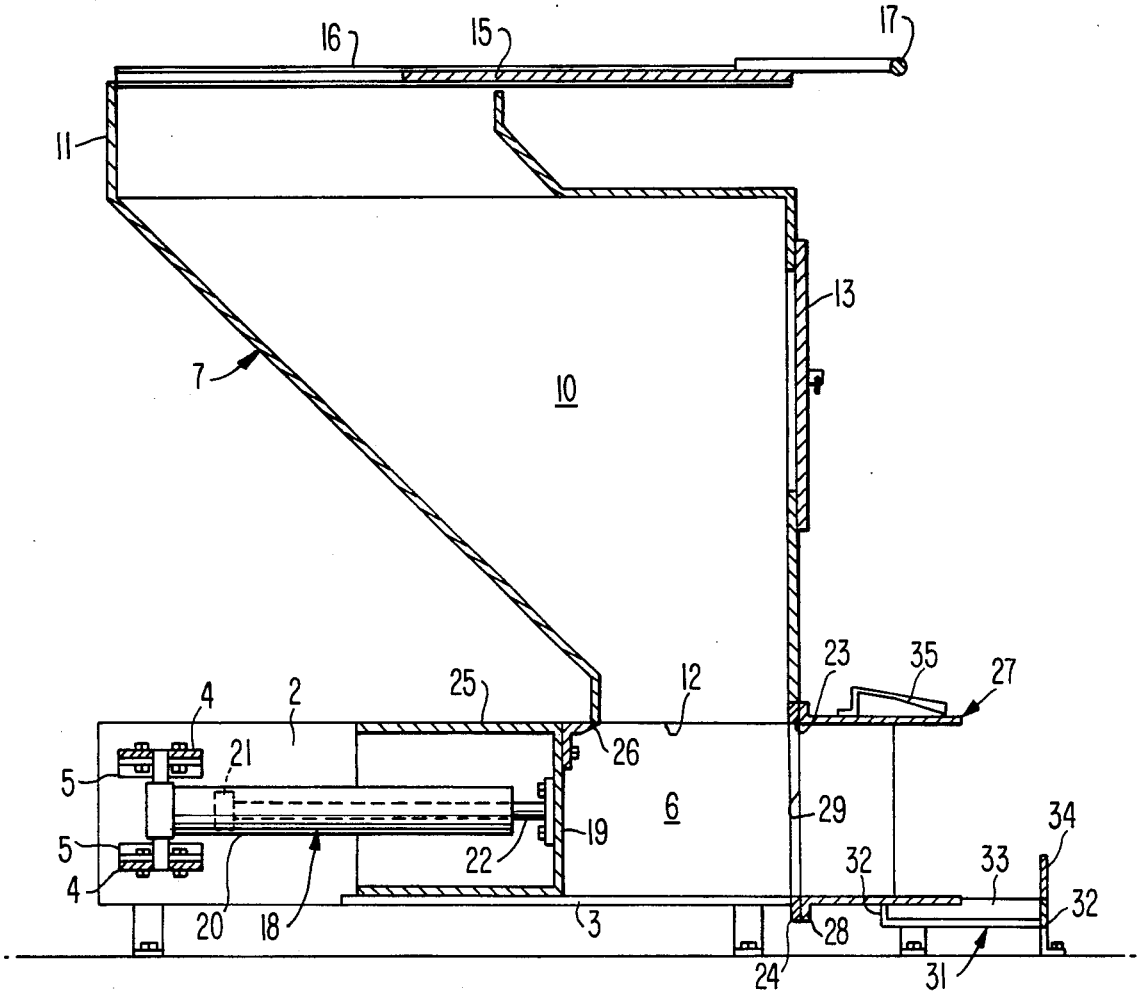
FIG. 3 is a sectional view substantially longitudinally of the apparatus of FIG. 1.

The base 1 defines a receiving chamber 6, FIG. 3, in the forward portion thereof having an inlet opening at the top into a hopper 7 for feeding trash by gravity into the receiving chamber 6. The hopper 7 is mounted on the side plates 2 by means of gusset plates 8 secured to flanges 9 on the upper edges of the side plates 2. The hopper 7 includes a transition portion 10 leading from a flue 11 to an outlet opening 12 in the bottom thereof that opens into the receiving chamber 6 and defines the outlet opening for the hopper as well as the inlet opening for the receiving chamber 6. The flue 11 is adapted to be connected for example to a trash chute in an apartment building so that trash that enters the hopper 7 through the flue 11 falls by gravity into the receiving chamber 6.

In the event that the hopper becomes clogged by trash bridging the side walls thereof, there are provided access doors such as the door 13 in the transition portion 10 the door 14 in the flue 11 through which the trash can be rodded to clear the same. The flue 11 is also provided with a shut-off gate 15 mounted for sliding movement in a pair of channel members 16 secured to the upper portion of the flue 11 and having a handle 17 for manually moving the gate to block the upwardly open end of the flue 11 or to open the same.

Trash in the receiving chamber 6 is adapted to be engaged by a ram 18 having a trash-engaging face 19 that conforms generally to the cross section of the receiving chamber 6, which as illustrated is substantially rectangular. The ram 18 also includes a hydraulic cylinder 20 having a double-acting linearly moving piston 21 at one end of a piston rod 22 that is connected at its other end to the rear surface of the trash-engaging face 19. The hydraulic cylinder 20 is secured at its end opposite from the trash-engaging face 19 to the braces 4. When the ram 18 is actuated it moves the face 19 linearly toward and on the centerline of an outlet opening 23 in a mounting plate 24 secured to the side plates 2 and bottom plate 3 at the discharge end of the receiving chamber 6 whereby the centerline of the opening 23 is substantially transverse to the centerline of the inlet opening formed by the open upper end of the receiving chamber 6 and opposed to the opening 12 of the hopper 7.

The trash-engaging face 19 of the ram has a skirt 25 the walls of which extend from the periphery and substantially parallel to the centerline of the trash-engaging face 19 in the direction away from the receiving chamber 6. Like the face 19, the skirt 25 conforms generally in outline to the cross section of the receiving chamber 6 and has a top wall portion that is adapted to close the opening 12 from the hopper 7 into the receiving chamber 6 when the ram is advanced toward the opening 23 in its compacting stroke and to open the opening 12 when the ram is retracted. A shearing blade 26 is carried by the trash-engaging face 19 at the upper edge thereof to sever the trash in the compacting chamber 6 from that in the hopper 7 and to prevent the face 19 from binding at the entrance of the opening 23 as the ram 18 is advanced.

A compacting chamber 27 which is substantially in the form of a rectangular conduit having a substantially uniform cross-section in the rectangular portion thereof, has a flange 28 at the inlet end 29 thereof for securing the same to the mounting plate 24 to receive trash forced through the outlet opening 23 by the trash-engaging face 19 of the ram 18. The outlet or discharge end 30 of the compacting chamber 27 is perpendicular to and thus defines the axis or centerline of the chamber 26, while the inlet end 29 is in a vertical plane that is at an angle that is preferably about forty five degrees to the centerline. The free edge of the inlet end 29 is substantially equal in dimensions to the outlet opening 23 of the receiving chamber 6, which in turn is substantially equal in dimensions to the cross-section of the receiving chamber 6 to provide a smooth path for trash to move freely from the receiving chamber 6 through the outlet opening 23 into the compacting chamber 27.

With the inlet end 29 formed on an angle to its centerline, the compacting chamber 26 extends obliquely from the outlet opening 23 of the receiving chamber 6 thereby providing resistance to the flow of the trash through the compacting chamber which in turn provides a face against which the trash being forced through the outlet opening 23 by the trash-engaging face 19 of the ram 18 is compacted.

At the discharge end 30 of the compacting chamber 27 there is disposed a roller conveyor 31 comprising side rails 32 between which a series of rollers 33 are journaled and a guide rail 34. The conveyor 31 is arranged to provide a smooth continuation of the bottom wall of the compacting chamber 26 so that the trash discharged from the end 30 moves sausage-like into bags stored on the periphery of the compacting chamber 26 behind the retainer 35 onto the conveyor for movement to a position for storage or for removal.

The conveyor 31 has a bend that is complementary to the angle of the compacting chamber 27 for delivering the compacted and bagged trash at a right angle to the centerline of the outlet opening 23 from the receiving chamber 6. In the illustrated apparatus, the angle of the compacting chamber 27 is about forty-five degrees and the bend in the conveyor 31 is also about forty-five degrees. While these angles are not critical, the angle of the compacting chamber 6 also determines the compacting pressure and it cannot be so great as to increase or decrease the compacting pressure above or below the desired maximum and minimum. As in the illustrated apparatus about forty-five degrees in both the compacting chamber 27 and in the conveyor 31 has been found to be a suitable comprise.

Bending the flow of the compacted and bagged trash from the discharge end of the compacting chamber is accomplished in accordance with this invention in less space longitudinally of the apparatus than can be accomplished with a ninety-degree conveyor and a compacting chamber in the form of an in-line reduction chamber. Not only does the compacting chamber compact the trash in less space longitudinally of the apparatus than the in-line reduction chamber but it also serves the added function of accomplishing a portion of the bend. This in turn also provides for a conveyor in which the lead-on portion at the loading end extends laterally to a large extent rather than solely in the direction longitudinally of the apparatus and thus further reduces the longitudinal dimension of the overall apparatus. Stated differently, since the portion of the conveyor that must be in-line with the discharge of the outlet opening 23 in order to receive the compacted and bagged trash is at an angle, it has a shorter component in the direction longitudinally of the machine.

Modifications from the disclosed embodiment of the invention will be obvious to those skilled in the art.

We claim:

1. A trash compactor comprising a receiving chamber having an inlet opening for receiving trash to be compacted and an outlet opening for compacted trash on a centerline transverse to the centerline of said inlet opening, an upwardly open hopper for receiving trash and disposed over said receiving chamber, said hopper having an opening connected to the inlet opening of said receiving chamber for delivering trash into said receiving chamber, a ram mounted for linear movement through said receiving chamber toward and from said outlet opening on a line defined by the centerline of said outlet opening, means for imparting linear movement to said ram, said ram having a trash-engaging face and a skirt extending from the periphery and substantially parallel to the centerline of said trash-engaging face in the direction away from said outlet opening for closing and opening said inlet opening as said ram moves toward and away from said outlet opening, a compacting chamber associated with said receiving chamber and having an inlet end connected to the outlet opening of said receiving chamber, a portion of said compacting chamber having a substantially uniform cross-section perpendicular to the centerline thereof and extending obliquely relative to the center of the outlet opening of said receiving chamber to an outlet end, and conveyor means adapted to receive compacted trash from the outlet end of said compacting chamber upon movement of said ram toward said outlet opening and having a portion extending obliquely to the centerline of said compacting chamber, whereby said compacting chamber and said conveyor means are adapted to deliver compacted trash at substantially a right angle to the centerline of the outlet opening of said receiving chamber.

2. A trash compactor in accordance with claim 1 wherein said compacting chamber extends at an angle of substantially forty-five degrees from the centerline of said outlet opening and said conveyor extends at an angle of substantially-forty-five degrees to the centerline of said compacting chamber.

* * * * *